US011092402B2

(12) United States Patent
Brown

(10) Patent No.: US 11,092,402 B2
(45) Date of Patent: Aug. 17, 2021

(54) ANGLED ACTION FIREARM

(71) Applicant: GGC Holdings, Inc., Powder Springs, GA (US)

(72) Inventor: William E. Brown, Powder Srpings, GA (US)

(73) Assignee: GGC Holdings, LLC., Powder Springs, GA (US)

( * ) Notice: Subject to any disclaimer, the term of this patent is extended or adjusted under 35 U.S.C. 154(b) by 0 days.

(21) Appl. No.: 16/861,291

(22) Filed: Apr. 29, 2020

(65) Prior Publication Data

US 2021/0018290 A1 Jan. 21, 2021

Related U.S. Application Data

(60) Provisional application No. 62/840,590, filed on Apr. 30, 2019.

(51) Int. Cl.

| | |
|---|---|
| ***F41A 25/10*** | (2006.01) |
| ***F41A 5/04*** | (2006.01) |
| *F41C 3/00* | (2006.01) |

(52) U.S. Cl.

CPC ..... *F41A 25/10* (2013.01); *F41A 5/04* (2013.01); *F41C 3/00* (2013.01)

(58) Field of Classification Search

CPC .... F41A 5/04; F41A 5/10; F41A 25/10; F41A 25/12; F41A 25/14; F41A 25/26; F41C 3/00; F41C 23/06

USPC ..... 42/1.06, 14, 15, 16, 17, 18, 39.5, 7

See application file for complete search history.

(56) References Cited

U.S. PATENT DOCUMENTS

| | | | | |
|---|---|---|---|---|
| 6,112,636 A * | 9/2000 | Besselink | ..... | F41A 5/18 89/184 |
| 8,037,805 B1 * | 10/2011 | Neroni | ..... | F41C 23/10 89/196 |
| 10,641,562 B2 * | 5/2020 | Patrick, IV | ..... | F41A 3/56 |

* cited by examiner

*Primary Examiner* — John Cooper

(74) *Attorney, Agent, or Firm* — Thomas | Horstemeyer, LLP

(57) ABSTRACT

Various embodiments for an angled action firearm that counteracts muzzle rise are described. The angled action firearm includes a receiver having a first receiver end and a second receiver end. The receiver has a top surface sloping upwards from the first receiver end to the second receiver end. The angled action firearm further includes a slide moveably coupled to the receiver having a bottom surface opposite that of the top surface of the receiver. The slide has a first slide end and a second slide end, where the angled bottom surface of the slide slopes upward from the first slide end to the second slide end. The angled action of the slide causes downward pressure during recoil counteracting muzzle rise.

20 Claims, 7 Drawing Sheets

ANGLED ACTION FIREARM

CROSS-REFERENCE TO RELATED APPLICATION

This application claims the benefit of and priority to U.S. Provisional Patent Application No. 62/840,590 entitled "ANGLED ACTION FIREARM," filed Apr. 30, 2019, the contents of which being incorporated by reference in their entirety herein.

BACKGROUND

Semiautomatic pistols are similar firearms generally include a frame, a slide moveably mounted on the frame, and a barrel positioned within the slide. The frame of a semiautomatic pistol generally includes a substantially horizontal and level top surface having a negligible slope or no slope. Similarly, the slide of a semiautomatic pistol generally includes a bottom surface having little or no slope. As will become apparent, the geometry of the frame and slide create muzzle rise, which is undesirable when firing. Notably, muzzle rise decreases accuracy when firing a firearm, especially when firing repeatedly.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
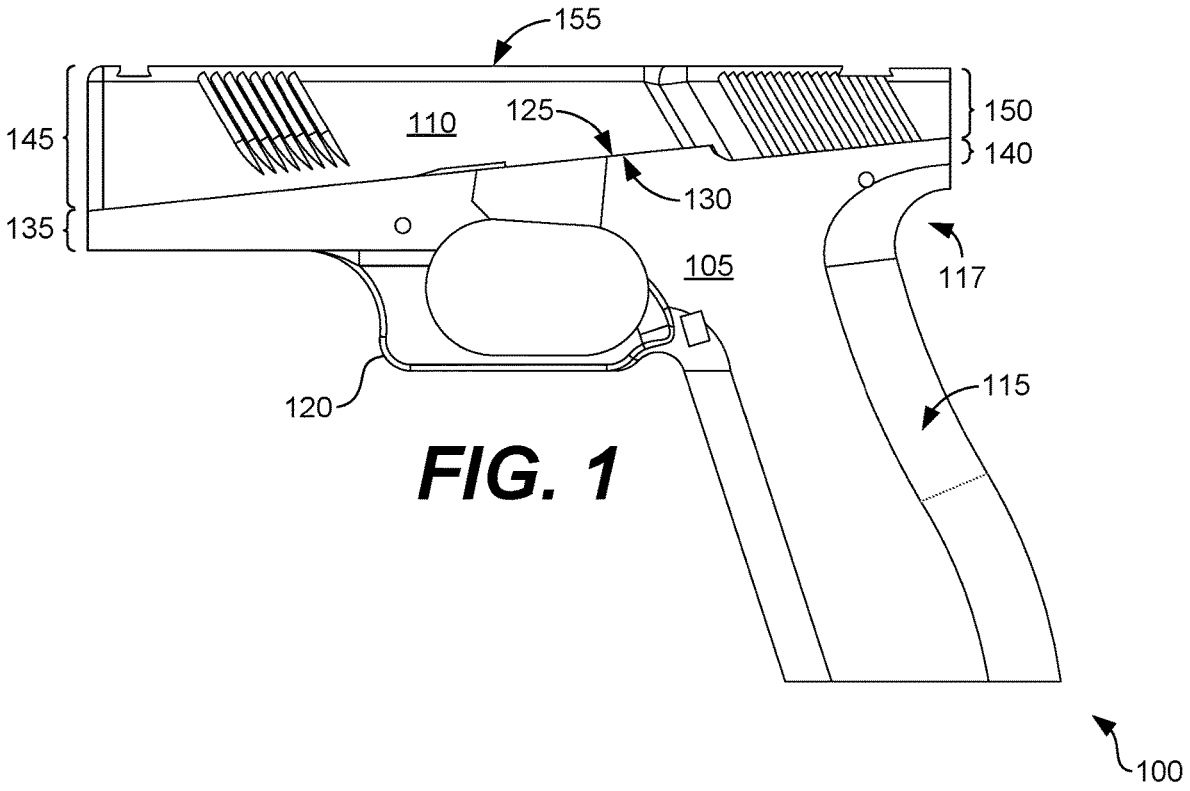
FIG. 1 is a side elevation view of an angled action pistol according to various embodiments of the present disclosure.

The present disclosure generally relates to an angled action firearm that counteracts muzzle rise when firing the firearm. Semiautomatic pistols generally include a frame, a slide moveably mounted on the frame, and a barrel positioned within the slide. The frame of a semiautomatic pistol generally includes a substantially horizontal and level top surface having little or no slope. Similarly, the slide of a semiautomatic pistol generally includes a bottom surface having little or no slope. As such, the slide is generally rectangular. The geometry of the frame and slide create muzzle rise, which is undesirable when firing. For instance, muzzle rise reduces accuracy during repeated firing where multiple projectiles are fired.

According to various embodiments, an angled action firearm is described that has a drastically reduced muzzle rise as compared to existing firearms. The angled action firearm may include a receiver, a slide, a barrel positioned between the receiver and the slide, and a firing mechanism, such as a trigger. The receiver of the angled action firearm may include a first receiver end and a second receiver end. The receiver may further include an angled top surface sloping upwards from the first receiver end to the second receiver end.

The slide of the angled action firearm may be moveably coupled to the receiver. The slide may include an angled bottom surface abutting the top surface of the receiver. The slide may include a first slide end and a second slide end. The angled bottom surface of the slide may slope upward from the first slide end to the second slide end. The first receiver end and the first slide end may be positioned at a muzzle end of the angled action pistol. Conversely, the second receiver end and the second slide end may be positioned at a striker end of the angled action pistol.

In various embodiments, the angled top surface of the receiver may have a slope of approximately four to eight degrees while the angled bottom surface of the slide may have a slope of approximately four to eight degrees. In some embodiments, the slope of the top surface may be substantially similar to the slope of the bottom surface of the slide. For instance, in some embodiments, the slope of the top surface of the receiver is approximately six degrees while the slope of the bottom surface of the slide is approximately six degrees.

Further, in various embodiments, the barrel of the angled action pistol may be pivotably coupled to the receiver. The barrel may include a barrel base and a recess positioned in the barrel base. In some embodiments, a circumference of the barrel base is greater than a circumference of a muzzle end of the barrel. During recoil, the slide is configured to contact the barrel base to push the barrel towards the striker end of the angled action firearm, for instance, until the recess of the barrel base comes into contact with a pivot projection. The pivot projection may interfere with the rearward movement of the barrel, causing the barrel to pivot about the pivot projection.

In additional embodiments, a weight of the slide of the angled action firearm may be greater than a weight of the receiver. Further, the first slide end may include a first height and the second slide end may include a second height. The first height of the first slide end may be greater than the second height of the second slide end in some embodiments. Also, the first height of the first slide end and the second height of the second slide end may be predetermined such that a top surface of the slide is substantially level when the angled action pistol is in-battery.

Further, in some embodiments, the first receiver end may include a first height while the second receiver end may include a second height. In various embodiments, the first height of the first receiver end may be less than the second height of the second receiver end. Additionally, in some embodiments, a width of the bottom surface of the slide may be equal or substantially similar to a width of the top surface of the receiver.

The embodiments for an angled action firearm provide many advantages over the existing state of the art. Notably, due to the slide being heavier than the frame, additional downward force is provided which counteracts muzzle rise during a firing of the angled action firearm. Additionally, as the receiver has an upward slope, the hand of the operator may be positioned higher relative to a longitudinal axis of the barrel, thereby providing an improved palm-grip-to-barrel ratio. Further, due to the upward slope of the receiver, the angled action firearm has the ability to support higher capacity magazines. Finally, the angled action firearm provides fewer misfeeds where a round is not properly chambered, which is one of the most common forms of malfunction with a firearm.

In the following discussion, a general description of various embodiments of an angled action firearm for counteracting muzzle rise is provided, followed by an example operation of the same.

Referring to FIG. 1, a side elevation view of an angled action pistol 100 is shown in accordance with various embodiments. Notably, the components of the angled action pistol 100 are shown in FIG. 1 as if the angled action pistol 100 were in-battery and ready to fire by an operator.

According to various embodiments, the angled action pistol 100 may include a receiver 105 (also referred to as a "frame"), a slide 110, as well as other components as will be described. The slide 110 may be slidably coupled to the receiver 105, as will be described. The receiver 105 may include a body of rigid material, such as metal, plastic, wood, or a combination thereof. Similarly, the slide 110 may include a body formed of a rigid material, such as metal. In various embodiments, the metal can be alloy metals, such as steel, stainless steel, chromium, molybdenum, vanadium, nickel, manganese, columbium, aluminum, titanium, or any combination thereof. Further, in some embodiments, various portions of the angled action firearm 100 may be formed of carbon fiber, fiberglass, plastic, or other suitable material.

In various embodiments, the slide 110 may be formed of a material such that a weight of the slide 110 is greater than a weight of the receiver 105. However, due to the size and shape of the slide 110 relative to the receiver 105, in some embodiments, the slide 110 and the receiver 105 may be formed of a common material while still providing the slide 110 with a weight greater than that of the receiver 105. The weight of the slide 110 being greater than that of the receiver 105 provides downward force while firing, thereby counteracting muzzle rise, as may be appreciated.

The receiver 105 may include a grip 115, a trigger guard 120, as well as a surface that moveably engages with the slide 110. For instance, the slide 110 may be slidably or movably coupled to the receiver 105 by way of one or more guides (not shown) that engage with recesses positioned within a bottom surface 125 of the slide 110. As such, the bottom surface 125 of the slide 110 may abut against and move along (and slide against) a top surface 130 of the receiver 105. The movement of the slide 110 along the top surface 130 of the receiver 105 may be referred to as horizontal displacement as the slide 110 moves horizontally relative to the receiver 105. For instance, in some embodiments, the angled action pistol 100 may include a slide 110 that displaces horizontally along the top surface 130 of the receiver 105 during a readying action in which the operator pulls the slide 110 rearward, or during a firing of the angled action pistol 100 where a round is fired.

The grip 115 of the receiver 105 may be ergonomically contoured to fit the hand of an operator when in-battery. As may be appreciated, the operator may include a marksman, hobbyist, law enforcement person, or other shooter. An arch in a hand of an operator, which generally includes the portion between the thumb and the index finger, may be positioned in a recessed portion 117 of the grip 115. The recessed portion 117 of the grip 115 may be positioned near the top surface 130 of the receiver 105, for instance, at the striker end of the angled action pistol 100.

Further, the trigger guard 120 may be positioned near the grip 115 to receive a trigger finger of the operator. The angled action pistol 100 may further include a firing mechanism, such as a trigger (not shown). For instance, a firing mechanism, such as a trigger, may be positioned in the trigger guard 120. However, for explanatory purposes, the firing mechanism is not shown in FIG. 1.

The receiver 105 may include a first receiver end 135 and a second receiver end 140. According to various embodiments, the top surface 130 of the receiver 105 may include a sloped or angled top surface. For instance, the top surface 130 of the receiver 105 may slope upwards from the first receiver end 135 to the second receiver end 140 of the receiver 105. As such, the first receiver end 135 is shown as being positioned lower on the receiver 105 than the second receiver end 140 relative to other components of the receiver 105, such as a longitudinal axis of a barrel (shown in FIG. 6), a bottom of the trigger guard 120, or a bottom of the receiver 105.

Further, the slide 110 may include a first slide end 145 and a second slide end 150. The bottom surface 125 of the slide 110 may include a sloped or angled bottom surface opposite that of and abutting against the top surface 130 of the receiver. For example, the first slide end 145 may slope upwards to the second slide end 150 or, in other words, the second slide end 150 may slope downwards to the first slide end 145.

As a top surface 155 of the angled action pistol 100 is substantially level (similar to traditional semi-automatic pistols) when in-battery and held by the operator, a height of the first slide end 145 may be greater than a height of the second slide end 150. In other words, the first slide end 145 may include a first height, and the second slide end 150 may include a second height, where the first height and the second height are predetermined such that the top surface 155 of the angled action pistol 100 is substantially level when the angled action pistol 100 is held by the operator. In other words, the receiver 105 and the slide 110 together form a substantially level surface relative to a ground surface or other horizontal plane. For instance, the first slide end 145 is shown as being positioned lower than the second slide end 150 relative to other components of the angled action pistol 100, such as a longitudinal axis of a barrel (shown in FIG. 6), a bottom of the trigger guard 120, or a bottom of the receiver 105.

The first receiver end 135 and the first slide end 145 are shown in FIG. 1 as being positioned at a muzzle end of the angled action pistol 100. The second receiver end 140 and the second slide end 150 may be positioned at a striker end, or a grip end, of the angled action pistol 100. In some embodiments, a width of the bottom surface 125 of the slide 110 may be equal or substantially similar to a width of the top surface 130 of the receiver 105.

Figure 2:
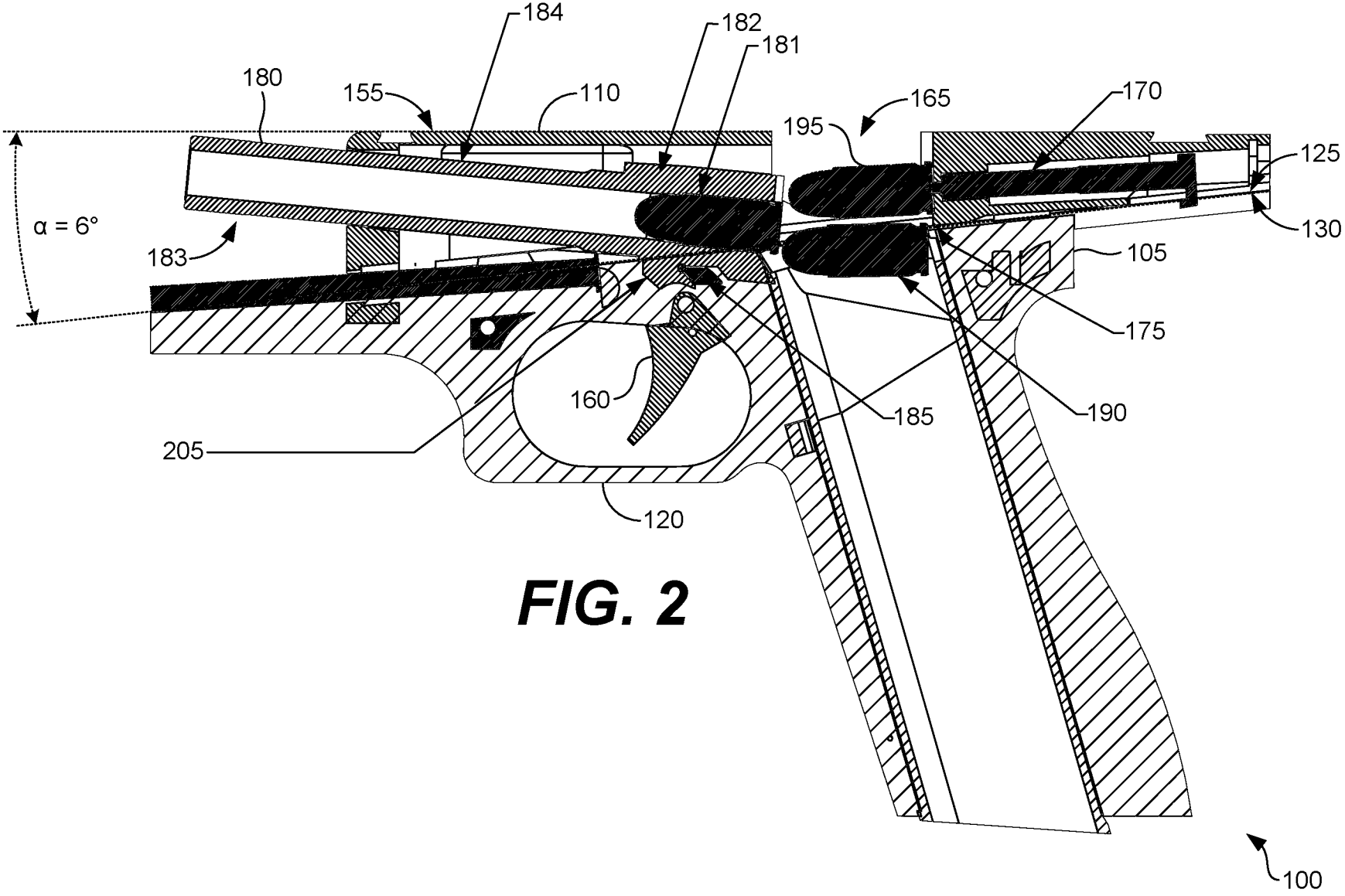
FIG. 2 is a side cross-sectional view of the angled action pistol in a full-recoil position according to various embodiments of the present disclosure.

Turning now to FIG. 2, a side cross-sectional view of the angled action pistol 100 is shown according to various embodiments. In FIG. 2, the angled action pistol 100 is shown in a full recoil position with the slide 110 being fully recoiled along the top surface 130 of the receiver 105. In other words, the slide 110 is displaced horizontally along a length of the top surface 130 of the receiver 105 to the maximum extent possible.

As noted above, the angled action pistol 100 may include a firing mechanism, such as a trigger 160, positioned within the trigger guard 120. The firing mechanism, such as the trigger 160, is configured to discharge the angled action pistol 100, thereby causing the slide 110 to displace relative to the receiver 105. Additionally, the angled action pistol 100 may include a chamber 165, a striker 170, a slide-feed lip 175, and a barrel 180. Also, for explanatory purposes, a chambered round 181, a feeding round 190, and an empty cartridge 195 are shown. It is understood that the firing mechanism may include additional components, such as a trigger linkage, but are not shown for explanatory purposes.

The barrel 180 may be pivotably coupled to the receiver 105 and/or the slide 110. In FIG. 2, the barrel 180 is shown in a lowered feeding position at full recoil where a muzzle end of the barrel 180 is shown tilted fully upward, while a striker end of the barrel 180 is shown lowered. The barrel 180 includes a barrel base 182 positioned on the distal, striker end of the barrel 180. In some embodiments, a circumference of the barrel base 182 may be greater than a circumference of a proximal, muzzle end 183 and a central region 184 of the barrel 180. As such, the barrel base 182 may cause the barrel 180 to move relative to the receiver 105 under impetus from the slide 110. For instance, the barrel 180 may be positioned in a recess of the slide 110 which causes the muzzle end of the barrel 180 to pivot upwards during recoil of the slide 110.

During recoil, the slide 110 comes into contact with the barrel base 182 and pushes the barrel 180 horizontally towards the striker end of the angled action pistol 100. The slide 110 may continue to push the barrel 180 horizontally until a recess in the barrel base 182 comes into contact with a pivot projection 185, as can be seen between the differences in the position of the barrel 180 observed in FIG. 4 and FIG. 5.

Referring back to FIG. 2, when the barrel 180 comes into contact with the pivot projection 185, the slide 110 will continue to force the barrel 180 towards the striker end, causing the barrel base 182 to pivot about the pivot projection 185 and directing the barrel base 182 to a rotated, lowered position. In other words, movement toward the striker end is stopped and the barrel 180 rotates about the pivot projection 185. It is understood that the horizontal movement of the slide 110 may cause the barrel 180 to pivot until a top of the muzzle end 183 of the barrel 180 comes into contact with the slide 110 and/or the barrel base 182 engaged with the pivot projection 185.

In an instance in which the trigger 160 is squeezed or otherwise engaged by the operator, a sear (not shown) may be dropped causing the striker 170 to release. A round positioned in the chamber 165 may be ignited by the striker 170 and a projectile may be expelled through the barrel 180, thereby causing the slide 110 to cycle the empty cartridge 195 and eject the empty cartridge 195 from the chamber 165 using an extractor (not shown).

Figure 3:
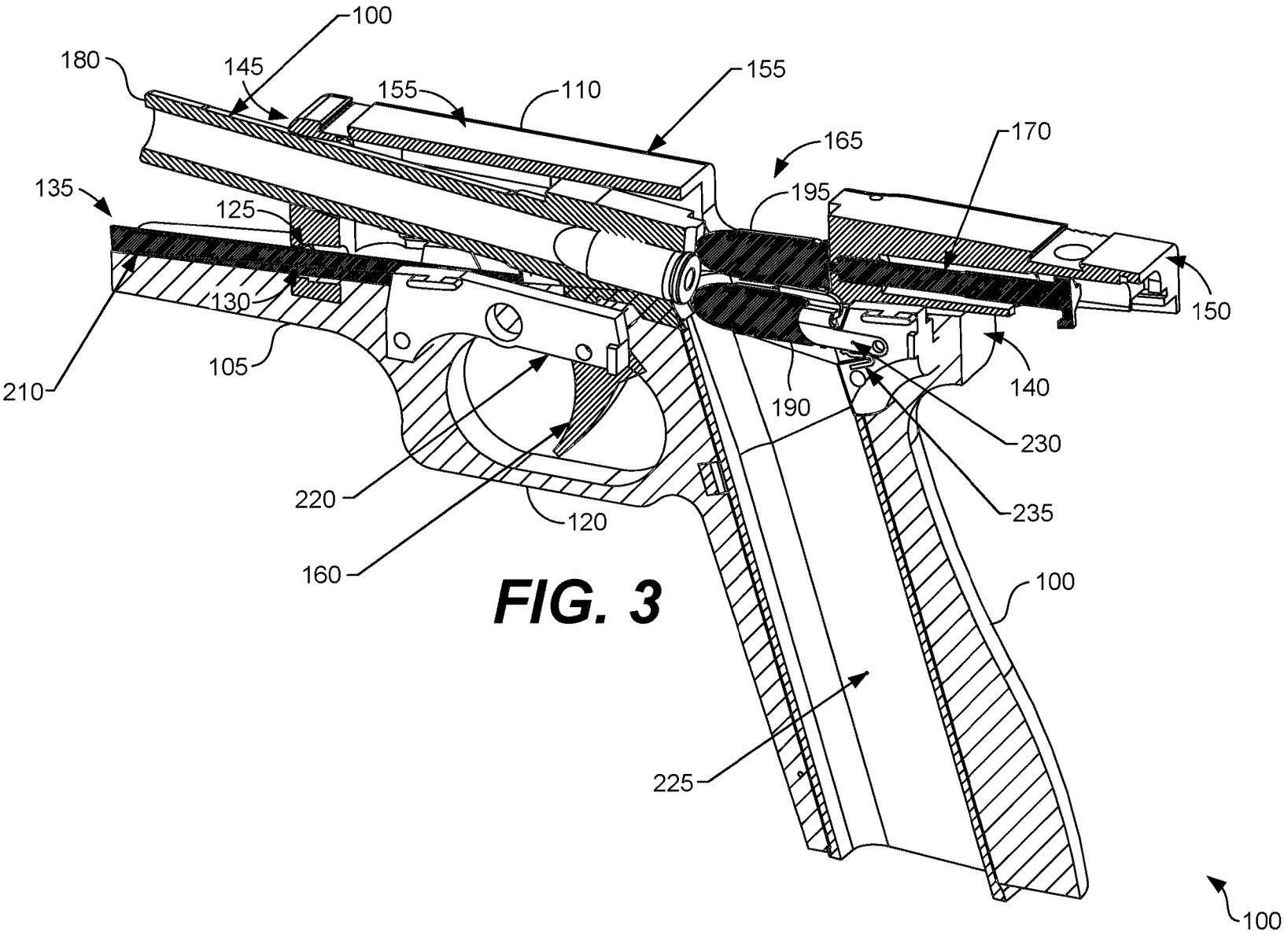
FIG. 3 is a perspective cross-sectional view of the angled action pistol in a full-recoil position according to various embodiments of the present disclosure.

The slide 110 cycles or, in other words, displaces horizontally along a top surface of the receiver 105, until contact is made with a pivoting ejector 230 shown in FIG. 3. Referring back to FIG. 2, the empty cartridge 195 is ultimately ejected from the angled action pistol 100. The barrel 180 is rotated and dropped into a lowered feeding position 205, as shown in FIG. 2. By virtue of the shape of the slide 110, the barrel 180 will pivot a greater angle relative to traditional pistols that feature a substantially rectangular slide having a non-angled bottom surface.

As the slide 110 returns to the in-battery position, a feed lip (not shown) may push the feeding round 190 into the chamber 165. The striker 170 is caught by the sear and the cycle may repeat until all rounds in the angled action pistol 100 are exhausted, or until the operator otherwise ceases firing. The angled action of the slide 110 causes downward pressure during recoil, which counteracts muzzle rise, especially during repetitive firing.

Further shown in FIG. 2, a slope of the top surface 130 of the receiver 105 and a slope of the bottom surface 125 of the slide 110 may be approximately six degrees ($\alpha$=6°). In other words, an angle of upward slope of the top surface 130 of the receiver 105 relative to a top surface 155 of the angled action pistol 100 may be approximately six degrees. Similarly, an angle of downward slope of the bottom surface 125 of the slide 110 relative to a top surface 155 of the angled action pistol 100 may be approximately six degrees. As such, the angled action pistol 100 may be described as having a six-degree angled slide action. However, in various embodiments, the angle of downward slope of the bottom surface 125 of the slide 110 and the angle of upward slope of the top surface 130 of the receiver 105 may be in the range of four to eight degrees.

The arch in a hand of the operator may be received in the recessed portion 117 of the grip 115, which may be positioned near the top surface 130 of the receiver 105 at the striker end of the angled action pistol 100. Due to the slope on the top surface 130 of the receiver 105, the barrel 180 may be located below a top of the wrist of an operator when the angled action pistol 100 is being held or in-battery. With the wrist and barrel 180 in this position, the recoil force which occurs when the angled action pistol 100 is fired is distributed more directly to the forearm of the operator, thereby counteracting barrel rise. Additionally, as the receiver 105 has an upward slope, the hand of the operator may be positioned higher relative to a longitudinal axis of the barrel 180, thereby providing an improved palm-grip-to-barrel ratio.

Moving on to FIG. 3, a perspective cross-sectional view of the angled action pistol 100 is shown according to various embodiments. Similar to FIG. 2, the angled action pistol 100 of FIG. 3 is shown in a full recoil position with the slide 110 being fully recoiled and displaced along the top surface 130 of the receiver 105. Additionally, similar to the cross-section view of FIG. 2, the barrel 180 is shown in the lowered feeding position 205 at full recoil.

According to various embodiments, the angled action pistol 100 may further include a recoil guide rod and mainspring 210, a locking block 220 (shown relative to the trigger 160), a magazine 225, a pivoting ejector 230, and an ejector spring 235. The recoil guide rod and mainspring 210 may include a guide rod positioned within the mainspring, which may include a spring braced between the slide 110 and the receiver 105 to hold the slide 110 and the barrel 180 in a forward and level position. Further, the recoil guide rod and mainspring 210 may control barrel jump through use of the mainspring, for instance, as the slide 110 recoils in response to a discharge of the angled action pistol 100.

As a result, the operator may have better ability to control movement of the angled action pistol 100 and increased accuracy during repetitive firing. As the slide 110 recoils rearward, the pivoting ejector 230 may come into contact with the empty cartridge 195, pushing it away from the breech face. Thereafter, pressure caused by the ejector spring 235 may cause the empty cartridge 195 to be expelled from the chamber 165 and the angle action pistol 100. Notably, the pivoting ejector 230 is shown in a full upwards position that occurs at full recoil. The locking block 220 may retain the slide 110 and the barrel 180 in a fixed position when the angled action pistol 100 is in-battery.

The magazine 225 may include a removable cartridge magazine in some embodiments for storing a plurality of rounds. As the top surface 130 of the receiver 105 slopes upwards, the receiver 105 may receive a magazine having a height greater than traditional magazines. As such, magazines 225 having a greater capacity of rounds may be used in the angled action pistol 100 described herein.

Figure 4:
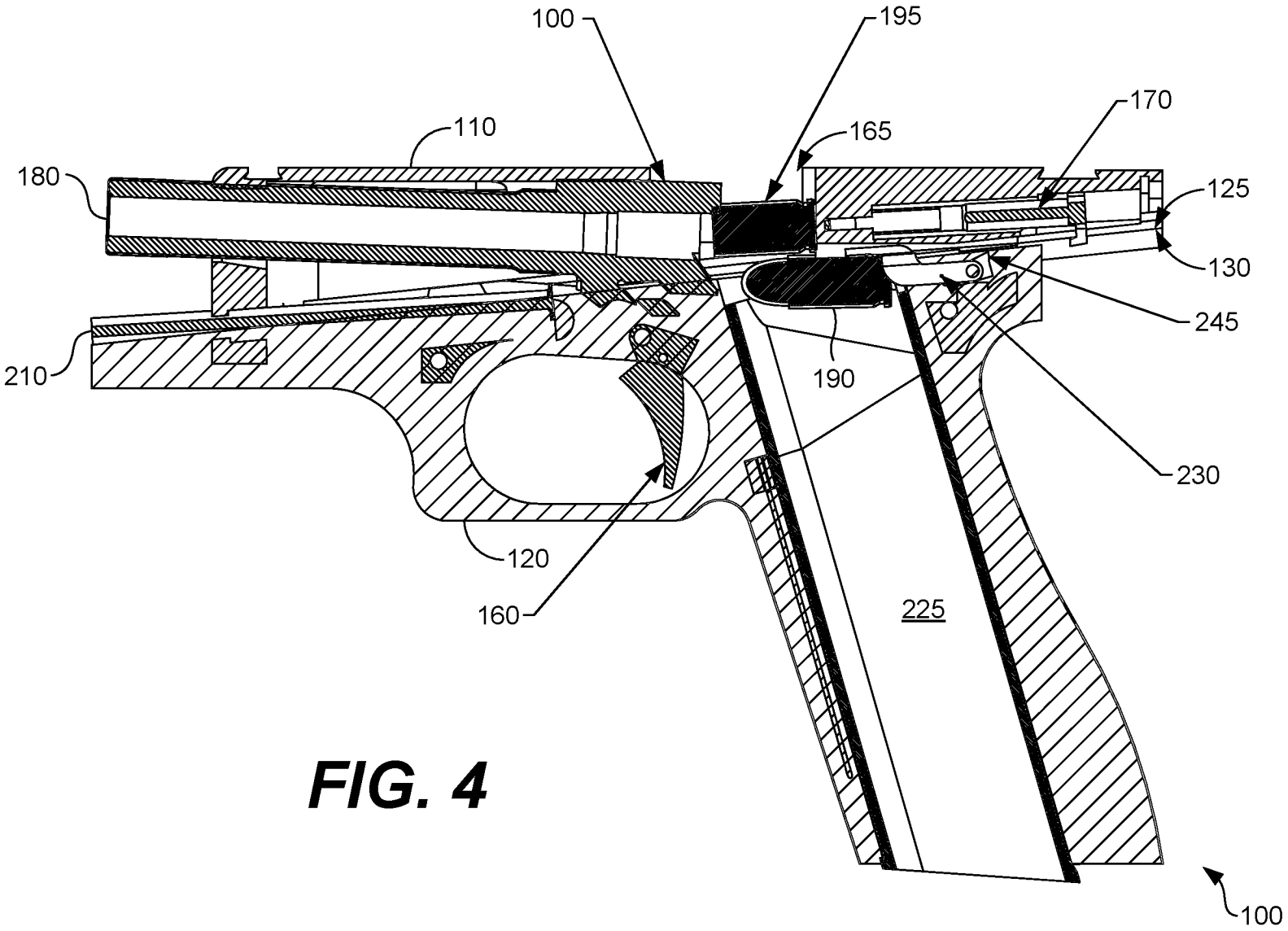
FIG. 4 is another side cross-sectional view of the angled action pistol in an intermediate-to-open position according to various embodiments of the present disclosure.

Referring now to FIG. 4, another side cross-sectional view of the angled action pistol 100 is shown according to various embodiments. Specifically, FIG. 4 depicts the angle action pistol 100 in an intermediary-to-open position that occurs during a discharge, for instance, when the slide 110 returns to a fully closed or "lockup" position after being in the full recoil position shown in FIGS. 2 and 3.

As noted above, the angled action pistol 100 may include a sear 245, which is shown in the non-limiting example of FIG. 4. In the intermediary-to-open position, the sear 245 may be in a reset position. The trigger 160 may be in a full, open position. Further, the pivoting ejector 230 may be in a semi-upward position such that the pivoting ejector 230 comes into contact with the feeding round 190. The striker 170 is shown in a dropped position and the empty cartridge 195 is shown being extracted from the chamber 165. It is understood that a muzzle end of the barrel 180, while still in an unlocked position, is moving downward to the lockup position as the slide 110 returns horizontally toward the muzzle end of the angled action pistol 100.

Figure 5:
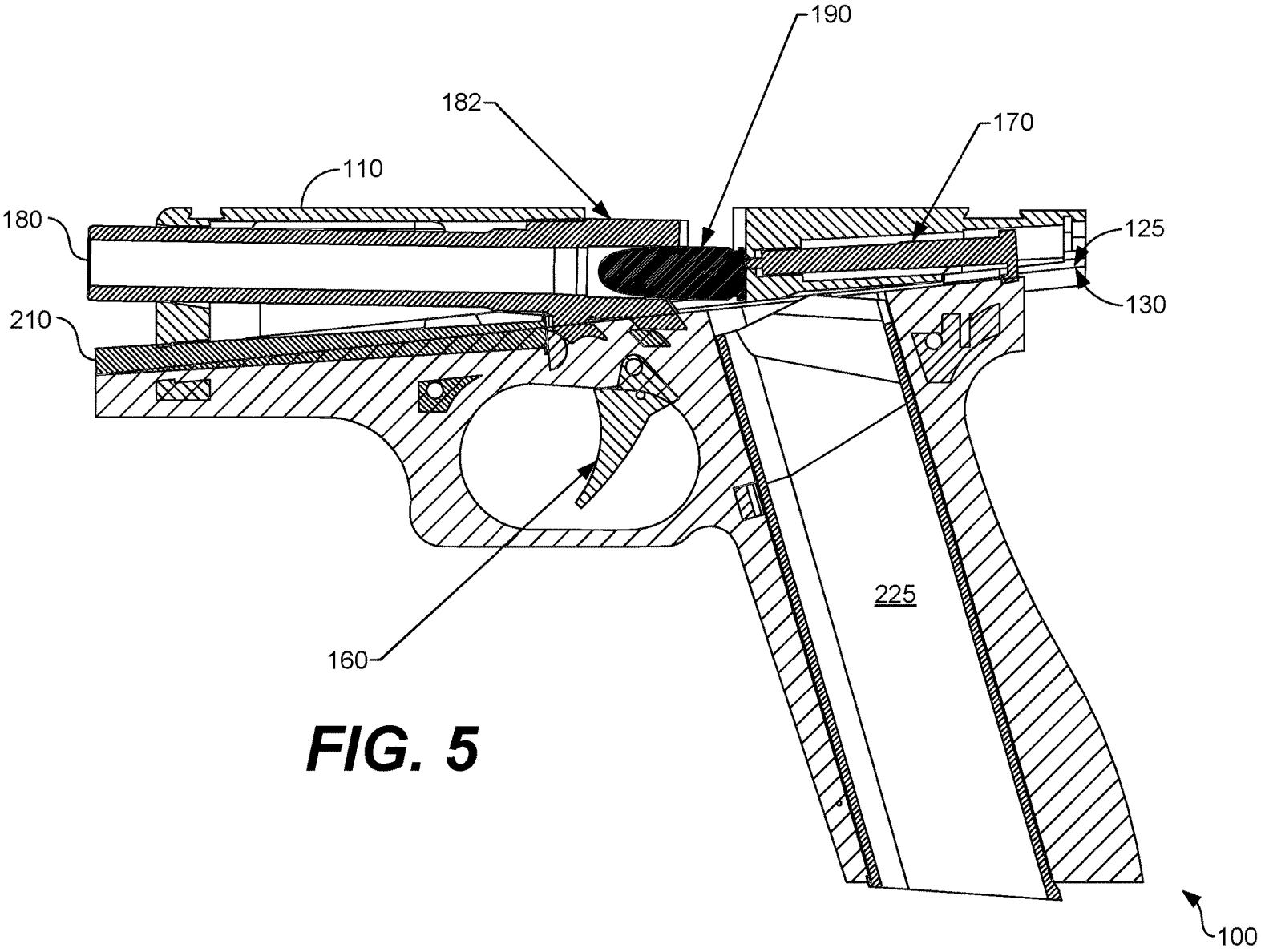
FIG. 5 is a side cross-sectional view of the angled action pistol in an intermediate-to-close position according to various embodiments of the present disclosure.

Moving on to FIG. 5, another side cross-sectional view of the angled action pistol 100 is shown according to various embodiments. For instance, FIG. 5 depicts the angled action pistol 100 in an intermediary-to-close position that occurs after a discharge when the slide 110 is returning to the lockup position. For instance, the intermediary-to-close position may include a position occurring after the intermediary-to-open position shown in FIG. 4.

In the intermediary-to-close position of FIG. 5, the striker 170 may be in a reset position. Similarly, the trigger 160 may be in a reset position. The barrel 180 may be in a near lockup position while still being unlocked. The barrel 180 continues to move downward to the lockup position as the slide 110 horizontally displaces, for instance, towards the muzzle end of the angled action pistol 100.

Figure 6:
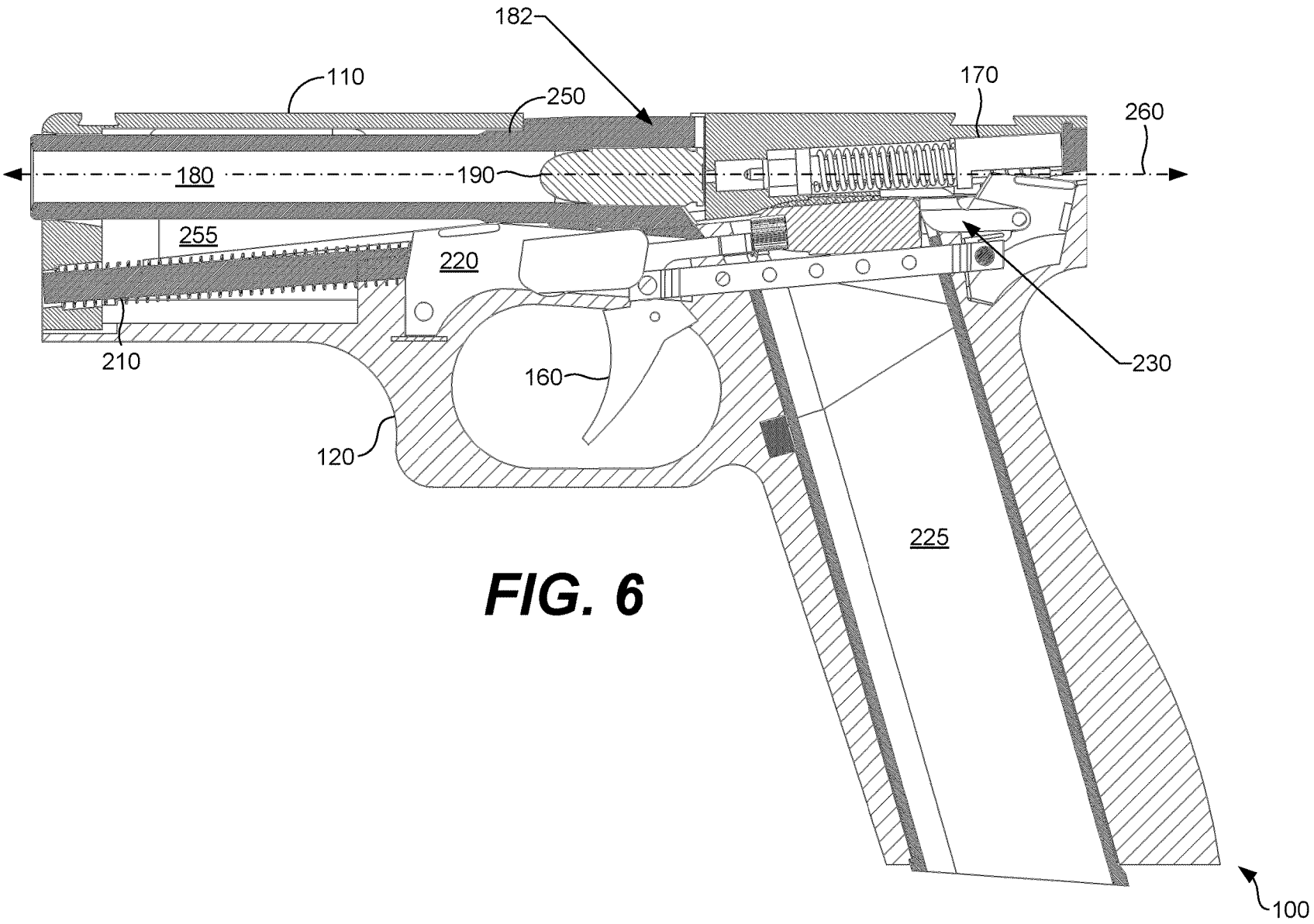
FIG. 6 is a side cross-sectional view of the angled action pistol in a closed, in-battery position according to various embodiments of the present disclosure.

Referring next to FIG. 6, another side cross-sectional view of the angled action pistol 100 is shown according to various embodiments. For instance, in FIG. 6, the angled action pistol 100 is shown in an in-battery position (and closed, lock-up position) that occurs prior to or after a discharge when the slide 110 is fully returned to the lockup position. Notably, the barrel 180 may be substantially level while the angled action pistol 100 is in-battery. Additionally, the barrel 180 may rest above the trigger guard 120 and extends into a cavity formed by the slide 110 and the receiver 105. In some embodiments, the barrel base 182 includes an annular shoulder 250 which abuts against a top of the slide 110. As such, the slide 110 may form an interference fit during recoil to direct the barrel 180 rearward until the recess of the barrel projection 182 comes into contact with the pivot projection 185.

FIG. 6 further depicts the position of the recoil guide rod and mainspring 210 while the angled action pistol 100 is in-battery. The recoil guide rod and mainspring 210 are angled upward and substantially parallel to the top surface 130 of the receiver 105. As such, a triangular cavity 255 is formed between the recoil guide rod and mainspring 210 and the barrel 180 while the angled action pistol 100 is in a closed state or in-battery.

As noted above, the slope of the top surface 130 of the receiver 105 and the slope of the bottom surface 125 of the slide 110 may be approximately six degrees ($\alpha$=6°). With respect to FIG. 6, an angle of upward slope of the top surface 130 of the receiver 105 relative to a longitudinal axis 260 of the barrel 180 of the angled action pistol 100 may be approximately six degrees when the angled action pistol 100 is in-battery and/or the barrel 180 is substantially level. Similarly, an angle of downward slope of the bottom surface 125 of the slide 110 relative to the longitudinal axis 260 of the barrel 180 may be approximately six degrees. As such, the angled action pistol 100 may be described as having a six-degree angled slide action. However, in various embodiments, the angle of downward slope of the bottom surface 125 of the slide 110 and the angle of upward slope of the top surface 130 of the receiver 105 relative to the longitudinal axis 260 of the barrel 180 may be in the range of four to eight degrees.

As a top surface 155 of the angled action pistol 100 is substantially level and parallel to the longitudinal axis 260 of the barrel 180 when in-battery, a height of the first slide end 145 relative to the longitudinal axis 260 of the barrel 180 may be greater than a height of the second slide end 150 relative to the longitudinal axis 260 of the barrel 180. In other words, the first slide end 145 may include a first height, and the second slide end 150 may include a second height, where the first height and the second height are predetermined such that the top surface 155 of the angled action pistol 100 is substantially level when the angled action pistol 100 is held by the operator. As such, the first slide end 145 is shown as being positioned lower than the second slide end 150 relative to the longitudinal axis 260 of the barrel 180.

Figure 7:
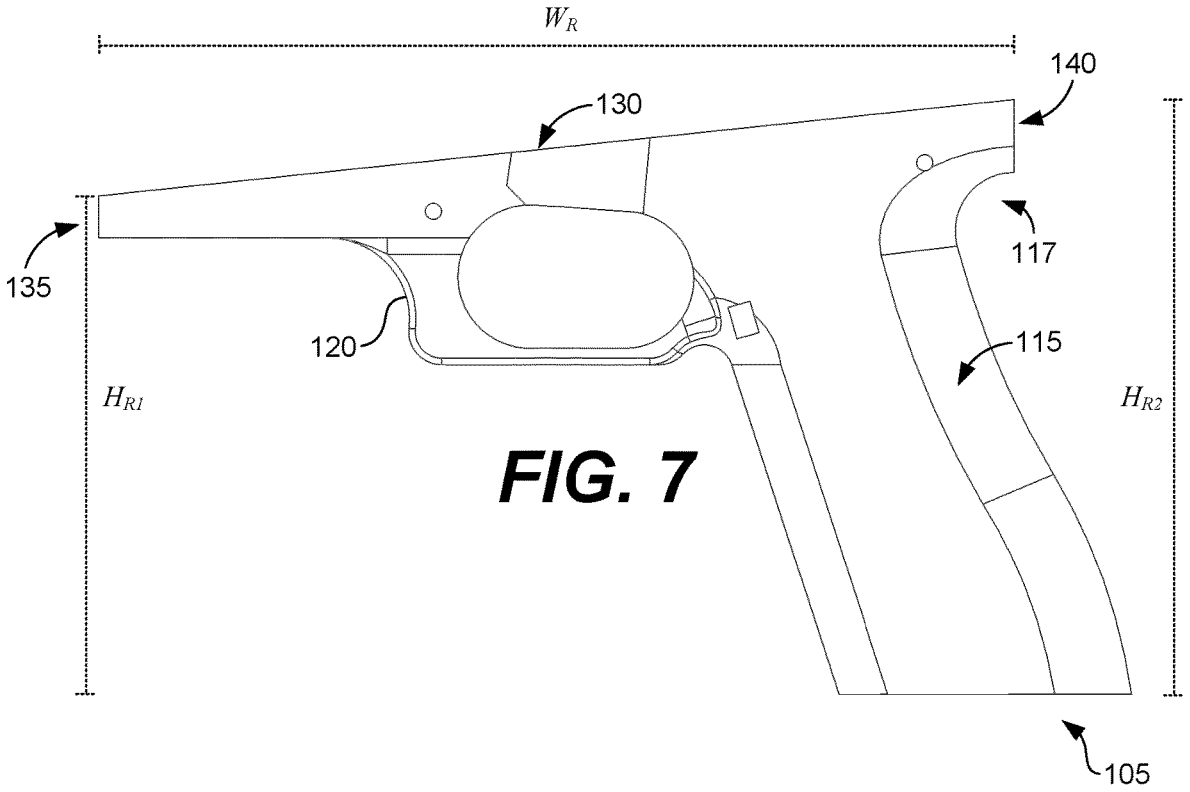
FIG. 7 is a side elevation view of a receiver of the angled action pistol according to various embodiments of the present disclosure.

Turning now to FIG. 7, a side view of the receiver 105 is shown independent of the other components of the angled action pistol 100 for explanatory purposes. The receiver 105 may include a first receiver end 135 and a second receiver end 140. In FIG. 7, the top surface 130 of the receiver 105 is shown as having an angled or a sloped top surface. For instance, the top surface 130 of the receiver 105 may slope upwards from the first receiver end 135 (e.g., the muzzle end) to the second receiver end 140 (e.g., the striker end) of the receiver 105.

Accordingly, the first receiver end 135 may include a height ($H_{R1}$) lower than a height ($H_{R2}$) of the second receiver end 140, for instance, when the angled action pistol 100 is in-battery. In other words, the first receiver end 135 may include a first height ($H_{R1}$), and the second receiver end 140 may include a second height ($H_{R2}$), where the first height ($H_{R1}$) is less than the second height ($H_{R2}$). The height ($H_{R1}$) of the first receiver end 135 and the height ($H_{R2}$) of the second receiver end 140 may be measured relative to a bottom of the receiver 105 and/or grip 115, as shown in FIG. 7. However, it is understood that the heights may be measured relative to another position, such as the longitudinal axis 260 of the barrel 180 shown in FIG. 6. Additionally, in some embodiments, a width ($W_R$) of the top surface 130 of the receiver 105 may be equal or substantially similar to a width ($W_S$) of the bottom surface 125 of the slide 110.

Figure 8:
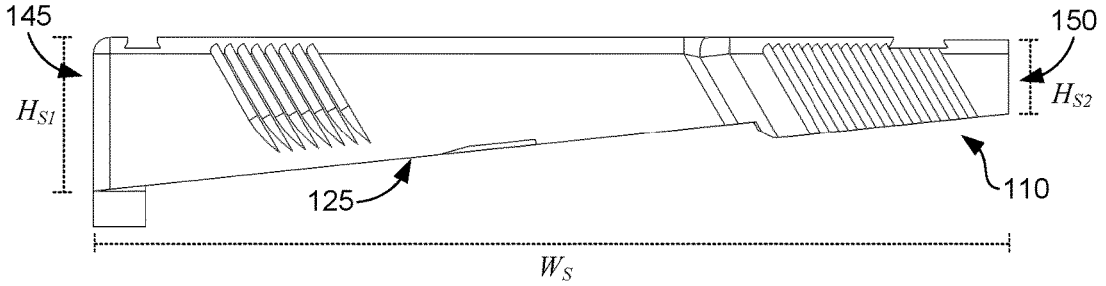
FIG. 8 is a side elevation view of a slide of the angled action pistol according to various embodiments of the present disclosure.

Referring next to FIG. 8, a side view of the slide 110 is shown independent of the other components of the angled action pistol 100 for explanatory purposes. The slide 110 may include the first slide end 145 and the second slide end 150. The bottom surface 125 of the slide 110 may include a sloped bottom surface sized and positioned to abut against the top surface 130 of the receiver. For example, the first slide end 145 may slope upwards to the second slide end 150.

As a top surface 155 of the angled action pistol 100, i.e., a top surface of the slide 110, is substantially aligned with and parallel to the barrel 180 (and the longitudinal axis 260 of the barrel 180) while the angled action pistol 100 is in-battery (similar to traditional semi-automatic pistols), a height ($H_{S1}$) of the first slide end 145 relative to a bottom of the slide 110 is greater than a height ($H_{S2}$) of the second slide end 150. In other words, the first slide end 145 may include a first height ($H_{S1}$), and the second slide end 150 may include a second height ($H_{S2}$), where the first height ($H_{S1}$) is greater than the second height ($H_{S2}$). It is understood that the heights may be measured relative to another position, such as the longitudinal axis 260 of the barrel 180 shown in FIG. 6. Also, the first height and the second height may be predetermined such that the top surface 155 of the angled action pistol 100 is substantially level or parallel to the longitudinal axis 260 of the barrel 180 when the angled action pistol 100 is in-battery. Further, in some embodiments, a width ($W_S$) of the bottom surface 125 of the slide 110 may be equal or substantially similar to a width ($W_R$) of the top surface 130 of the receiver 105.

Although relative terms are used in this specification, such as "up" and "down" to describe the relative relationship between one component and another component of an icon, these terms are used in this specification for convenience only, for example according to the directions of the examples described in the drawings. It can be understood that if the device is turned upside down, the component described "up" will become the component "down." When a structure is "on" or "positioned on" another structure, it may mean that a structure is integrally formed on another structure, or that a structure is "directly" arranged on another structure, or that a structure is arranged "indirectly" on another structure through another structure.

The terms "a," "an," "the," and "said" are used to indicate that there are one or more elements, components, etc. The terms "comprising" and "having" are used to indicate open-ended inclusion, and refers to that, in addition to the listed elements, components, etc., there may be other elements, components, etc. The terms "first," "second," etc. are used only as labels, and are not intended to be a limitation on the number of objects. It is understood that if the specification described a plurality of components, individual ones of the components can be referred to as a first component, a second component, and so forth.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An angled action firearm, comprising:

a barrel having a longitudinal axis, the barrel comprising a barrel base and a recess positioned in the barrel base;

a receiver comprising a first receiver end and a second receiver end, the receiver further comprising an angled top surface sloping upwards from the first receiver end to the second receiver end relative to the longitudinal axis of the barrel, wherein the barrel is pivotably coupled to the receiver;

a slide slidably coupled to the receiver having an angled bottom surface opposite that of the angled top surface of the receiver, the slide comprising a first slide end and a second slide end, wherein the angled bottom surface of the slide slopes upward from the first slide end to the second slide end relative to the longitudinal axis of the barrel; and a firing mechanism configured to discharge the angled action firearm, thereby causing the slide to displace relative to the receiver.

2. The angled action firearm of claim 1, wherein:

the first receiver end and the first slide end are positioned at a muzzle end of the angled action firearm; and the second receiver end and the second slide end are positioned at a striker end of the angled action firearm.

3. The angled action firearm of claim 1, wherein:

the angled top surface of the receiver has a slope of approximately four to eight degrees; and the angled bottom surface of the slide has a slope of approximately four to eight degrees.

4. The angled action firearm of claim 3, wherein:

the angled top surface of the receiver has a slope of approximately six degrees; and the angled bottom surface of the slide has a slope of approximately six degrees.

5. The angled action firearm of claim 1, wherein:

a circumference of the barrel base is greater than a circumference of a muzzle end of the barrel; and during recoil, the slide is configured to contact the barrel base to push the barrel towards the striker end of the angled action firearm until the recess of the barrel base comes into contact with a pivot projection, the pivot projection causing the barrel to pivot about the pivot projection.

6. The angled action firearm of claim 1, wherein a weight of the slide is greater than a weight of the receiver.

7. The angled action firearm of claim 1, wherein:

the first slide end has a first height relative to the longitudinal axis of the barrel;

the second slide end has a second height relative to the longitudinal axis of the barrel;

the first height of the first slide end is greater than the second height of the second slide end; and the first height of the first slide end and the second height of the second slide end are predetermined such that a top surface of the slide is substantially level when the angled action firearm is an in-battery position.

8. The angled action firearm of claim 7, wherein:

the first receiver end has a first height relative to the longitudinal axis of the barrel;

the second receiver end has a second height relative to the longitudinal axis of the barrel; and the first height of the first receiver end is less than the second height of the second receiver end.

9. The angled action firearm of claim 8, wherein a width of the angled bottom surface of the slide is equal or substantially similar to a width of the angled top surface of the receiver.

10. The angled action firearm of claim 1, further comprising a recoil guide rod and a mainspring angled upward when the angled action firearm is in an in-battery position, wherein the recoil guide rod and the mainspring are positioned substantially parallel to the angled top surface of the receiver.

11. The angled action firearm of claim 1, wherein the angled action firearm is an angled action pistol.

12. A method, comprising:

providing an angled action firearm, wherein the angled action firearm comprises:

a barrel having a longitudinal axis, the barrel comprising a barrel base and a recess positioned in the barrel base;

a receiver comprising a first receiver end and a second receiver end, the receiver further comprising an angled top surface sloping upwards from the first receiver end to the second receiver end relative to the longitudinal axis of the barrel, wherein the barrel is pivotably coupled to the receiver;

a slide slidably coupled to the receiver having an angled bottom surface opposite that of the angled top surface of the receiver, the slide comprising a first slide end and a second slide end, wherein the angled bottom surface of the slide slopes upward from the first slide end to the second slide end relative to the longitudinal axis of the barrel; and a firing mechanism configured to discharge the angled action pistol, thereby causing the slide to displace relative to the receiver.

13. The method of claim 12, wherein:

the first receiver end and the first slide end are positioned at a muzzle end of the angled action firearm; and the second receiver end and the second slide end are positioned at a striker end of the angled action firearm.

14. The method of claim 13, wherein:

the angled top surface of the receiver has a slope of approximately four to eight degrees; and the angled bottom surface of the slide has a slope of approximately four to eight degrees.

15. The method of claim 14, wherein:

the angled top surface of the receiver has a slope of approximately six degrees; and the angled bottom surface of the slide has a slope of approximately six degrees.

16. The method of claim 12, wherein:

a circumference of the barrel base is greater than a circumference of a muzzle end of the barrel; and during recoil, the slide is configured to contact the barrel base to push the barrel towards a striker end of the angled action firearm until the recess of the barrel base comes into contact with a pivot projection, the pivot projection causing the barrel to pivot about the pivot projection.

17. The method of claim 16, wherein a weight of the slide is greater than a weight of the receiver.

18. The method of claim 17, wherein:

the first slide end has a first height relative to the longitudinal axis of the barrel;

the second slide end has a second height relative to the longitudinal axis of the barrel;

the first height of the first slide end is greater than the second height of the second slide end;

the first height of the first slide end and the second height of the second slide end are predetermined such that a top surface of the slide is substantially level when the angled action firearm is in an in-battery position;

the first receiver end has a first height relative to the longitudinal axis of the barrel;

the second receiver end has a second height relative to the longitudinal axis of the barrel; and the first height of the first receiver end is less than the second height of the second receiver end; and the angled action firearm is an angled action pistol comprising a recoil guide rod and a mainspring angled upward when the angled action pistol is in an in-battery position, wherein the recoil guide rod and the mainspring are positioned substantially parallel to the top surface of the receiver.

19. An angled action pistol, comprising:

a barrel having a longitudinal axis, the barrel comprising a barrel base and a recess positioned in the barrel base, wherein a circumference of the barrel base is greater than a circumference of a muzzle end of the barrel;

a receiver comprising a first receiver end and a second receiver end, the receiver further comprising an angled top surface sloping upwards from the first receiver end to the second receiver end relative to the longitudinal axis of the barrel, wherein the barrel is pivotably coupled to the receiver;

a slide slidably coupled to the receiver having an angled bottom surface opposite that of the angled top surface of the receiver, the slide comprising a first slide end and a second slide end, wherein the angled bottom surface of the slide slopes upward from the first slide end to the second slide end relative to the longitudinal axis of the barrel; and a firing mechanism configured to discharge the angled action pistol, thereby causing the slide to displace relative to the receiver, wherein, during recoil, the slide is configured to contact the barrel base to push the barrel towards the striker end of the angled action pistol until the recess of the barrel base comes into contact with a pivot projection, the pivot projection causing the barrel to pivot about the pivot projection.

20. The angled action pistol of claim 19, wherein:

the first slide end has a first height relative to the longitudinal axis of the barrel;

the second slide end has a second height relative to the longitudinal axis of the barrel;

the first height of the first slide end is greater than the second height of the second slide end;

the first height of the first slide end and the second height of the second slide end are predetermined such that a top surface of the slide is substantially level when the angled action pistol is in an in-battery position;

the first receiver end has a first height relative to the longitudinal axis of the barrel;

the second receiver end has a second height relative to the longitudinal axis of the barrel; and the first height of the first receiver end is less than the second height of the second receiver end; and the angled action pistol further comprises a recoil guide rod and a mainspring angled upward when the angled action pistol is in an in-battery position, wherein the recoil guide rod and the mainspring are positioned substantially parallel to the top surface of the receiver.

* * * * *